US005464484A

United States Patent [19]

Rodzewich

[11] Patent Number: 5,464,484

[45] Date of Patent: Nov. 7, 1995

[54] OIL SPLITTING ALUMINUM CLEANER AND METHOD

[75] Inventor: Edward A. Rodzewich, Flourtown, Pa.

[73] Assignee: Betz Laboratories, Inc., Trevose, Pa.

[21] Appl. No.: 255,218

[22] Filed: Jun. 7, 1994

[51] Int. Cl.[6] ..... B08B 3/08

[52] U.S. Cl. ..... 134/40; 134/22.14; 134/22.19; 252/528; 252/547; 252/174.21

[58] Field of Search ..... 134/2, 40, 22.14, 134/22.19; 252/528, 547, 174.21

[56] References Cited

U.S. PATENT DOCUMENTS

| | | | |
|---|---|---|---|
| 4,174,304 | 11/1979 | Flanagan | 252/524 |
| 4,340,509 | 7/1982 | Canale et al. | 252/529 |
| 4,349,448 | 9/1982 | Steele | 252/135 |
| 4,374,734 | 2/1983 | Newcombe | 210/708 |
| 4,382,825 | 5/1983 | McReady | 134/2 |
| 4,457,322 | 7/1984 | Rubin et al. | 134/2 |
| 4,517,025 | 5/1985 | Plante et al. | 134/38 |
| 4,576,743 | 3/1986 | Kita et al. | 252/524 |
| 4,938,893 | 7/1990 | Copeland et al. | 252/527 |
| 5,114,607 | 5/1992 | Deck et al. | 252/156 |

*Primary Examiner*—W. Gary Jones
*Assistant Examiner*—Sean Vincent
*Attorney, Agent, or Firm*—Alexander D. Ricci; Philip H. Von Neida

[57] ABSTRACT

Compositions and methods for cleaning aluminum while providing oil splitting and no oxide build-up on the aluminum surface including an alkali metal silicate and a quaternary cationic surfactant in an alkaline aqueous cleaning solution.

7 Claims, No Drawings

OIL SPLITTING ALUMINUM CLEANER AND METHOD

FIELD OF THE INVENTION

The present invention relates to an oil splitting aluminum cleaner and methods for using the same. This aqueous cleaner provides effective cleaning of aluminum surfaces while providing fast oil splitting and no oxide build-up on the aluminum surface.

BACKGROUND OF THE INVENTION

In industry, it is often necessary to clean aluminum surfaces for a variety of purposes, such as preparation for paint or for a conversion coating. Satisfactory treatment requires that any dirt and lubricant used in the aluminum forming process be removed before proceeding with additional steps.

Alkaline and acid cleaners have found wide use in the cleaning of aluminum. Acid etching and cleaning with, for example, hydrofluoric acid gives good results producing clean, mirror bright surfaces. However, the use of acids for cleaning present safety and effluent problems and necessitates the use of stainless steel for the cleaning equipment. Alkaline cleaners are thus favored in the aluminum forming and processing industry.

The accumulation of oils in cleaning solutions presents a threefold problem. Oils make metal cleaning more difficult as the capacity of the surfactants to emulsify oil becomes limited. Second, the oils in alkaline baths may saponify and contribute to foaming. Lastly, subsequent treatment of the bath effluent must separate out the emulsified oils prior to discharge. Higher treatment levels of surfactants are often used to remedy the problem of insufficient cleaning due to the presence of the oils. This not only increases the cost of the treatment but also the cost of cleaning treatment prior to effluent discharge.

Virtually any material which is capable of removing oil contamination from an aluminum surface will possibly remove some aluminum. This circumstance, particularly when coupled with the economic necessity of recycling the cleaner bath, will cause ever increasing amounts of aluminum in the bath. At some point, these insoluble aluminum compounds will drop out of the cleaning solution in the form of a sludge which, if left unchecked, will redeposit as a film or smut on the just cleaned aluminum.

The present inventor has found a way of lessening these problems by discovering a novel cleaner composition which provides good cleaning of aluminum surfaces while also providing fast oil splitting with no oxide build-up on the aluminum surface.

SUMMARY OF THE INVENTION

The present invention provides for an aluminum cleaner composition and method for using the cleaner on formed aluminum surfaces. The aqueous, alkaline cleaner utilizes low levels of a nonionic surfactant and a quaternary cationic surfactant to achieve aluminum cleaning with good oil splitting ability and no oxide build-up on the surface of the aluminum being cleaned.

DESCRIPTION OF THE RELATED ART

U.S. Pat. No. 5,114,607, Deck et al., teaches a cleaning and etching solution and method for metal surfaces. This comprises an aqueous alkaline solution of a metal salt of gluconic acid, an alkali tripolyphosphate and a surfactant combination of a low foaming ethylene oxide-propylene oxide block copolymer and a defoaming reverse ethylene oxide-propylene oxide block copolymer.

DETAILED DESCRIPTION OF THE INVENTION

The present invention relates to an aqueous, alkaline cleaner composition and method for cleaning aluminum in a cleaning bath and the splitting of oil in the cleaning bath comprising applying to the aluminum an effective amount for both cleaning and splitting oil present in the cleaning bath of an aqueous, alkaline composition of an alkali metal phosphate, a nonionic surfactant, an alkali metal silicate, and a quaternary cationic surfactant.

The cleaner composition and methods of this invention provide both effective cleaning of the aluminum surface and quick and efficient oil splitting in the aqueous bath where cleaning occurs. By "in situ" it is meant that the oil splitting occurs in the cleaning bath and that the bath water is not removed to another location and treated with additional chemicals not present in the cleaning solution. This advantage is not only in the efficiency of not adding a separate, oil splitting step to the cleaning process but also in the downtime and cost necessary for replacement or replenishment of chemicals. The cleaner composition also provides cleaning with substantially no etching of the aluminum surface. Lastly, another step is eliminated when there is no oxide build-up on the aluminum surface which often is removed for functional and cosmetic reasons.

The quaternary cationic surfactant is effective as an oil splitting component of the cleaner composition. The preferred quaternary cationic surfactant is quaternary dimethyl benzyl ammonium chloride and is available from Mason Chemical as Macquat Cationic Surfactant 8OE.

The nonionic surfactant assists in the cleaning operation and makes it easier for the cleaning liquid to contact the aluminum surface being cleaned. The preferred nonionic surfactants are the homologous series of octylphenoxypoly-(ethyleneoxy)ethanol compounds available from Rhone-Poulenc, with the most preferred being sold under the tradename Igepal CA-630.

The alkali metal silicate compound is employed to inhibit oxide build-up, staining, and darkening on the aluminum surface being cleaned. Examples of useful silicate salts include but are not limited to sodium metasilicate, anhydrous and sodium metasilicate, pentahydrate with the anhydrous sodium metasilicate being preferred.

The alkali metal phosphate assists in the cleaning process by acting principally as a soil suspending agent. The phosphate also acts as a builder in the aqueous solution. Examples of alkali metal phosphates include but are not limited to sodium tripolyphosphate and tetrapotassium pyrophosphate, with a 60% aqueous solution of tetrapotassium pyrophosphate being preferred.

An aqueous cleaning composition in accordance with the present invention generally has the following concentrations, by volume:

| Ingredient | Concentration (%) |
|---|---|
| Deionized water | Remainder |
| Tetrapotassium Pyrophosphate (60% aqueous solution) | 5 to 30 |
| Sodium Metasilicate, anhydrous | 1 to 10 |

-continued

| Ingredient | Concentration (%) |
|---|---|
| Macquat Cationic Surfactant 80E | 1 to 5 |
| Igepal 630 | 1 to 5 |
| Defoamer (when necessary) | 0.1 to 1.0 |

A preferred aqueous concentration in accordance with the present invention comprises by volume:

| Ingredient | Concentration (%) |
|---|---|
| Deionized water | 76.6 |
| Tetrapotassium Pyrophosphate (60% aqueous solution) | 15.0 |
| Sodium Metasilicate, anhydrous | 5.0 |
| Macquat Cationic Surfactant 8OE | 1.8 |
| Igepal CA-630 | 1.6 |

This concentrate would be diluted to approximately 1 to 6% in water, preferably 4% prior to use. The methods of the invention comprise applying the cleaner composition to the aluminum by either spraying with the cleaner composition or immersion in the cleaner composition. Either method results in contamination of the cleaner composition by oil which will eventually split from the aqueous composition in the cleaner bath. The compositions of the present invention allow for faster splitting and subsequent removal of the oil by a process such as skimming which results in a cleaner bath substantially free of oil. This bath can then be employed to clean more aluminum by either spray or immersion. Although both means of applying the cleaner composition provide effective results, spraying is the preferred means of application.

The cleaning solutions are effective for cleaning the aluminum surfaces at temperatures from ambient (~60° F.) to about 160° F., with cleaning preferred at 140° F. When temperatures are at ambient ranges, foaming of the sprayed solution can occur. In this instance, a defoamer may be added to the inventive composition. One defoamer useful in this invention is a siloxane glycol copolymer, marketed as XRM-3588E by Ultra Additives, Inc.

Following the cleaning step, which is preferably spraying the inventive solution on the aluminum surface for 60 seconds, the aluminum surface is rinsed with an ambient tap water rinse to remove the cleaning solution.

The invention will now be further described with reference to a number of specific examples which are to be regarded solely as illustrative, and not as restricting the scope of the invention.

Experimental

The evaluation of the inventive cleaner composition on aluminum is determined by testing for water break free ability, oil splitting ability, and oxide build-up.

The testing was performed utilizing a cleaner composition designated Cleaner A with and without a defoamer present. Cleaner A has the ingredients:

| Ingredient | (% wt.) |
|---|---|
| Deionized water | 89.75 |

-continued

| Ingredient | (% wt.) |
|---|---|
| Sodium tripolyphosphate | 5.00 |
| Sodium metasilicate, pentahydrate | 2.00 |
| Igepal CA-630 | 1.00 |
| Macquat Cationic Surfactant 80E | 2.00 |
| Ultra Additive XRM-3588E | 0.25 |

I. Cleaning Soil Test

Cleaned and weighed 4"×6"3003 aluminum panels were immersed in mixed radiator oils and allowed to drip dry. After weighing, the panels were cleaned for 60 seconds, rinsed, dried and weighed. The panels were rated for % water break free (% WBF), % oil removed (% OR) from the panel and panel appearance. These results appear in Table I.

TABLE I

Cleaner A for 60 seconds at 70° F. and 18 psig

| Cleaner | Initial weight of Oil on Panel | Weight of oil After Cleaning | % OR | % WBF |
|---|---|---|---|---|
| Cleaner A | 1.2101 | 0.0000 | 100.00 | 10 |
| Cleaner A | 1.3005 | 0.0001 | 99.99 | 8 |
| Cleaner A without defoamer | 1.1925 | 0.0001 | 99.99 | 100 |
| Cleaner A without defoamer | 1.2005 | 0.0000 | 100.00 | 100 |

Based on the weight measurements, essentially all of the oil was removed from the surface of the panels. The panels appeared clean and bright with no evidence of darkening or staining. Foam generation was minimal and averaged between 0.5 and 1 inch at 2000 ppm radiator oil contamination. Further, these results illustrate that the defoamer does not affect oil removal but does affect water break free.

II. Oxide Build-Up Test

Cleaned and weighed 2"×2 3003 aluminum coupons were immersed in the cleaner solution for 3 hours at ambient temperature. The coupons were then removed from the cleaner, rinsed with deionized water and allowed to air dry. The cleaner bath was evaluated with and without a defoamer. These results are presented in Table II.

TABLE II

2% v/v Cleaner A

| Cleaner | Initial weight Coupon | Final weight After Cleaning | % Change |
|---|---|---|---|
| Cleaner A | 4.2993 | 4.2993 | 0.00 |
| Cleaner A | 4.2295 | 2.2994 | 0.00 |
| Cleaner A without defoamer | 4.2840 | 4.2838 | 0.00 |
| Cleaner A without defoamer | 4.1234 | 4.1233 | 0.00 |

These results indicate that the inventive composition forms no oxide on the surface of the aluminum. This is indicative of the aluminum not being etched while it is cleaned. This is important from aluminum cleaning and bath efficiency as well as bath water waste treatment standpoints.

III. Oil Splitting Test 25 mL of mixed radiator oils was added to 425 mL of a 2% v/v solution of cleaner A at ambient temperature. This mixture was stirred rapidly for 5 minutes at 5000 rpm. After mixing, the contents was poured into a clear 500 mL graduated cylinder. After 1 minute the foam level and the oil split was measured and reported in mL. These measurements were repeated every 5 minutes up to 15 minutes. An 80% oil split in 15 minutes is considered a good indicator of effective oil splitting. These results are reported in Table III.

TABLE III

| | 2% v/v Cleaner A | |
|---|---|---|
| Time (minutes) | Oil Separation | Foam |
| 1 | 0 mL | 5 mL |
| 2 | 22–23 mL | none |
| 10 | 25 mL | none |
| 15 | 25 mL | none |

These tests were repeated several times with the same results being observed. As seen from these results, good oil splitting was obtained in 5 minutes. This is indicative of the cleaner composition providing effective removal of oil from the aluminum surfaces being cleaned.

The novel cleaner composition provides effective cleaning of aluminum surfaces of dirt and residue. These tests also show that the cleaner composition provides effective oil splitting, or removal of oil from an aluminum surface, and no oxide build-up, or etch of the aluminum surface being cleaned.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for cleaning aluminum with an aqueous cleaning solution and for splitting oil in an aqueous cleaning bath containing oil and said aqueous cleaning solution comprising applying to said aluminum an effective cleaning amount of said aqueous cleaning solution which comprises an alkali metal phosphate, octylphenoxypolyethyleneoxyethanol, sodium metasilicate, and a quaternary cationic surfactant, whereby said aqueous cleaning solution provides substantially no etching of said aluminum and substantially no oxide buildup on said aluminum.

2. The method as claimed in claim 1 wherein said cationic surfactant is quaternary dimethyl benzyl ammonium chloride.

3. The method as claimed in claim 1 wherein said alkali metal phosphate is tetrapotassium pyrophosphate.

4. The method as claimed in claim 1 wherein said aqueous cleaning solution is diluted to 1 to about 6% by weight in water.

5. The method as claimed in claim 1 wherein said aqueous cleaning solution is sprayed onto said aluminum surface.

6. The method as claimed in claim 1 wherein said aqueous cleaning solution is at a temperature from 60° F. to 160° F.

7. The method as claimed in claim 1 wherein said aqueous cleaning solution further comprises a defoamer compound.

* * * * *